US008197189B2

(12) United States Patent
Bonniere et al.

(10) Patent No.: US 8,197,189 B2
(45) Date of Patent: Jun. 12, 2012

(54) VIBRATION DAMPING OF A STATIC PART USING A RETAINING RING

(75) Inventors: Philippe Bonniere, Don Mills (CA); Andreas Eleftheriou, Woodbridge (CA); Ignatius Theratil, Mississauga (CA); Aldo Abate, Longueuil (CA)

(73) Assignee: Pratt & Whitney Canada Corp., Longueuil (CA)

( * ) Notice: Subject to any disclaimer, the term of this patent is extended or adjusted under 35 U.S.C. 154(b) by 1232 days.

(21) Appl. No.: 11/945,490

(22) Filed: Nov. 27, 2007

(65) Prior Publication Data

US 2009/0136348 A1 May 28, 2009

(51) Int. Cl.
*F01D 5/10* (2006.01)

(52) U.S. Cl. ..... 415/119

(58) Field of Classification Search ..... 415/119, 415/206, 213.1; 416/190
See application file for complete search history.

(56) References Cited

U.S. PATENT DOCUMENTS

| | | | | |
|---|---|---|---|---|
| 2,945,290 | A | 7/1960 | Walsh | |
| 3,326,523 | A | 6/1967 | Bob | |
| 4,113,052 | A | 9/1978 | McElroy, Jr. | |
| 4,116,171 | A * | 9/1978 | Schulmeister et al. | 123/41.57 |
| 4,325,650 | A | 4/1982 | Masai | |
| 4,361,213 | A | 11/1982 | Landis, Jr. et al. | |
| 4,411,592 | A * | 10/1983 | Traver et al. | 415/119 |
| 4,491,184 | A | 1/1985 | Kawaharazuka | |
| 4,621,976 | A | 11/1986 | Marshall et al. | |
| 5,346,362 | A | 9/1994 | Bonner et al. | |
| 5,432,307 | A | 7/1995 | Maurer | |
| 5,681,142 | A | 10/1997 | Lewis | |
| 5,733,103 | A | 3/1998 | Wallace et al. | |
| 6,149,382 | A | 11/2000 | Englander et al. | |
| 6,485,241 | B1 | 11/2002 | Oxford | |
| 6,494,679 | B1 * | 12/2002 | Gadre et al. | 416/145 |
| 7,223,020 | B2 | 5/2007 | Bauer et al. | |
| 7,997,857 | B2 * | 8/2011 | Battig et al. | 415/119 |

* cited by examiner

*Primary Examiner* — Edward Look
*Assistant Examiner* — Ryan Ellis
(74) *Attorney, Agent, or Firm* — Norton Rose Canada LLP

(57) ABSTRACT

A retaining ring is mounted in frictional engagement with a static gas turbine engine part, such as a compressor shroud, in order to provide frictional damping.

16 Claims, 2 Drawing Sheets

VIBRATION DAMPING OF A STATIC PART USING A RETAINING RING

TECHNICAL FIELD

The invention relates generally to vibration damping and, more particularly, to vibration damping of static engine parts using a retaining ring.

BACKGROUND OF THE ART

Mechanical frictional damping is often used to dissipate vibrations in machines with rotating parts. The type of friction damper to be used is a function of the type of motion (mode shapes and frequencies) to be damped. Not all friction dampers can be fitted mechanically nor may perform as well in all applications. The mounting and localisation of the damper on the part also affect the amount of damping obtained. The surrounding environment in which the damper is to be used must also be taken into account. Accordingly, several damping schemes typically may have to be tested in order to determine the amount of damping that can be obtained for each particular application. In addition to being efficient, the solution must be inexpensive, easy to assemble while still being reliable.

There is thus an ongoing need to provide new vibration damping schemes for different parts to be damped.

SUMMARY

In one aspect, there is provided a gas turbine engine compressor comprising a rotor mounted for rotation about a central axis of the engine, the rotor having a series of circumferentially distributed blades, each of said blades having a tip, a shroud surrounding said rotor and having a radially inwardly facing surface defining a flowpath and with the tip of said blades a tip clearance, and a retaining ring mounted to a radially outwardly facing surface of the shroud, said retaining ring being in frictional engagement with said radially outwardly facing surface of said shroud, the friction and relative motion between the retaining ring and the shroud provides damping of the vibration deflection induced in the shroud.

In a second aspect, there is provided a vibration damping arrangement comprising a static gas turbine engine part subject to vibrations, a multi-turn retaining ring mounted in frictional engagement with the static gas turbine engine part, each turn of the multi-turn retaining ring being in frictional contact with an adjacent turn, the multi-turn retaining ring having a radial stiffness sufficient to cause the retaining ring to slip on the static gas turbine engine part in response to vibratory motion of the static engine part, the slip between the adjacent turns of the retaining ring as well as between the retaining ring and the static gas turbine engine part both causing frictional damping of the vibration induced in the static gas turbine engine part.

In a third aspect, there is provided a method of damping vibration induced in a static annular shroud, wherein the annular shroud is subject to deflections induced by vibration, the method comprising: opposing the deflections by externally mounting a retaining ring in frictional engagement with an outer surface of the annular shroud, the retaining ring having a radial stiffness sufficient to substantially not conform to the shroud deflections, thereby resulting in relative sliding motion between the shroud and the retaining ring, the relative sliding motion providing frictional damping of the vibration.

In a fourth aspect, there is provided a method of damping vibration induced in a static gas turbine engine part, comprising: providing a multi-turn retaining ring of the type used to fasten a first part to a second part, the multi-turn retaining ring having at least two turns; and causing said retaining ring to slip on an external surface of the static shroud and said at least two turns to slip relative to each other as a reaction to vibration induced in the static gas turbine engine part, the friction between the multi-turn retaining ring and the static gas turbine engine part as well as the friction between the at least two turns of the multi-turn retaining ring providing vibration damping.

The term "retaining ring" is herein intended to refer to rings usually used as fasteners to retain a component in a shaft or a bore. The ring may for instance be provided in the form of a single turn ring or a multi-turn spiral wound ring with wavy, bowed and/or dished shapes. Several single turn rings can be mounted side by side on the part to be dampened in order to provide the additional frictional benefit offered by multi-turn rings. The term "multi-turn ring" is, thus, herein intended to refer to rings having multiple spiral coils as well as to arrangements of multiple adjacent single-turn rings.

Further details of these and other aspects of the present invention will be apparent from the detailed description and figures included below.

DESCRIPTION OF THE DRAWINGS

Reference is now made to the accompanying figures depicting aspects of the present invention, in which.

DETAILED DESCRIPTION OF THE PREFERRED EMBODIMENTS

Figure 1:
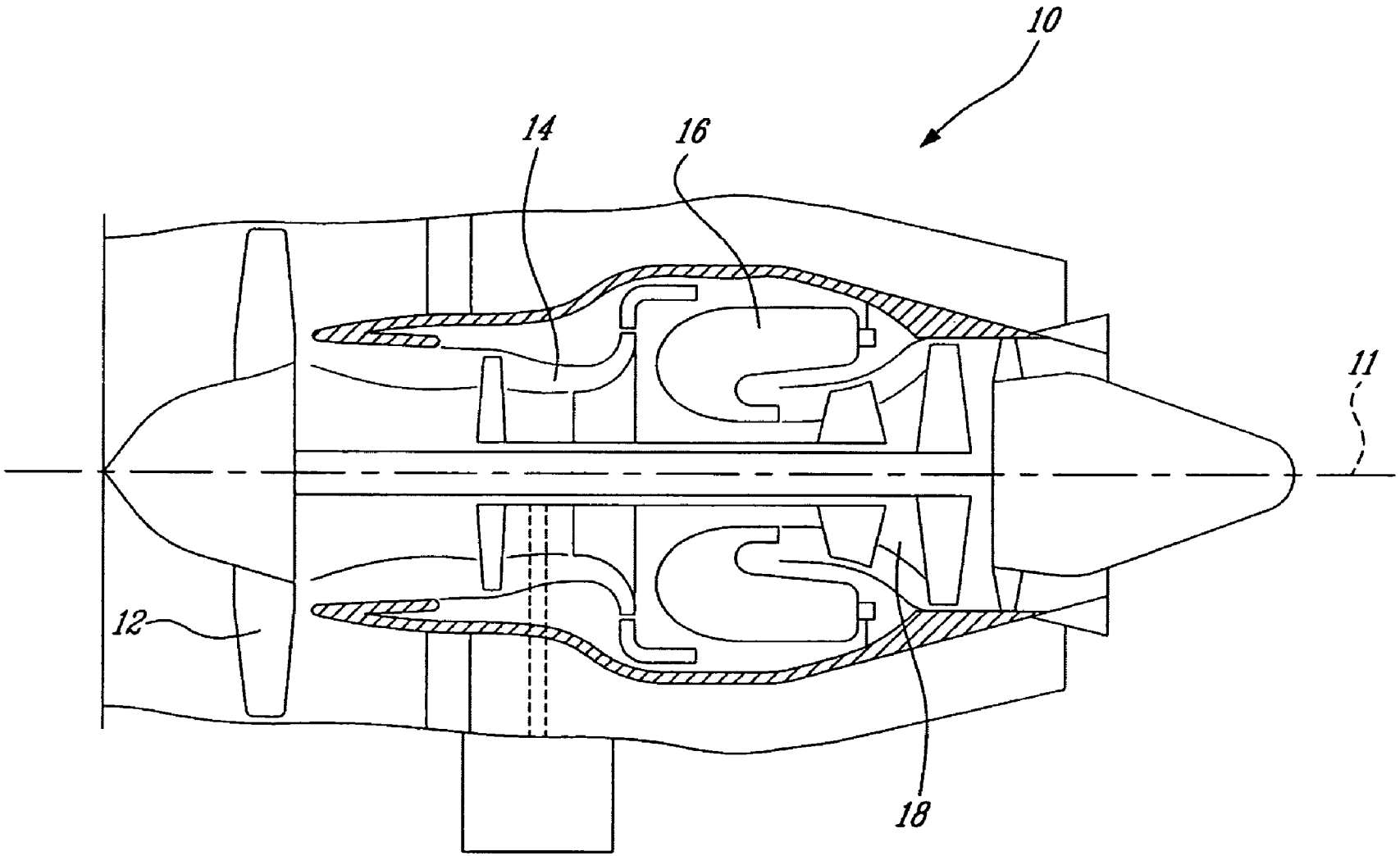
FIG. 1 is a schematic cross-sectional view of a gas turbine engine.

FIG. 1 illustrates a gas turbine engine 10 generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases.

Figure 2:
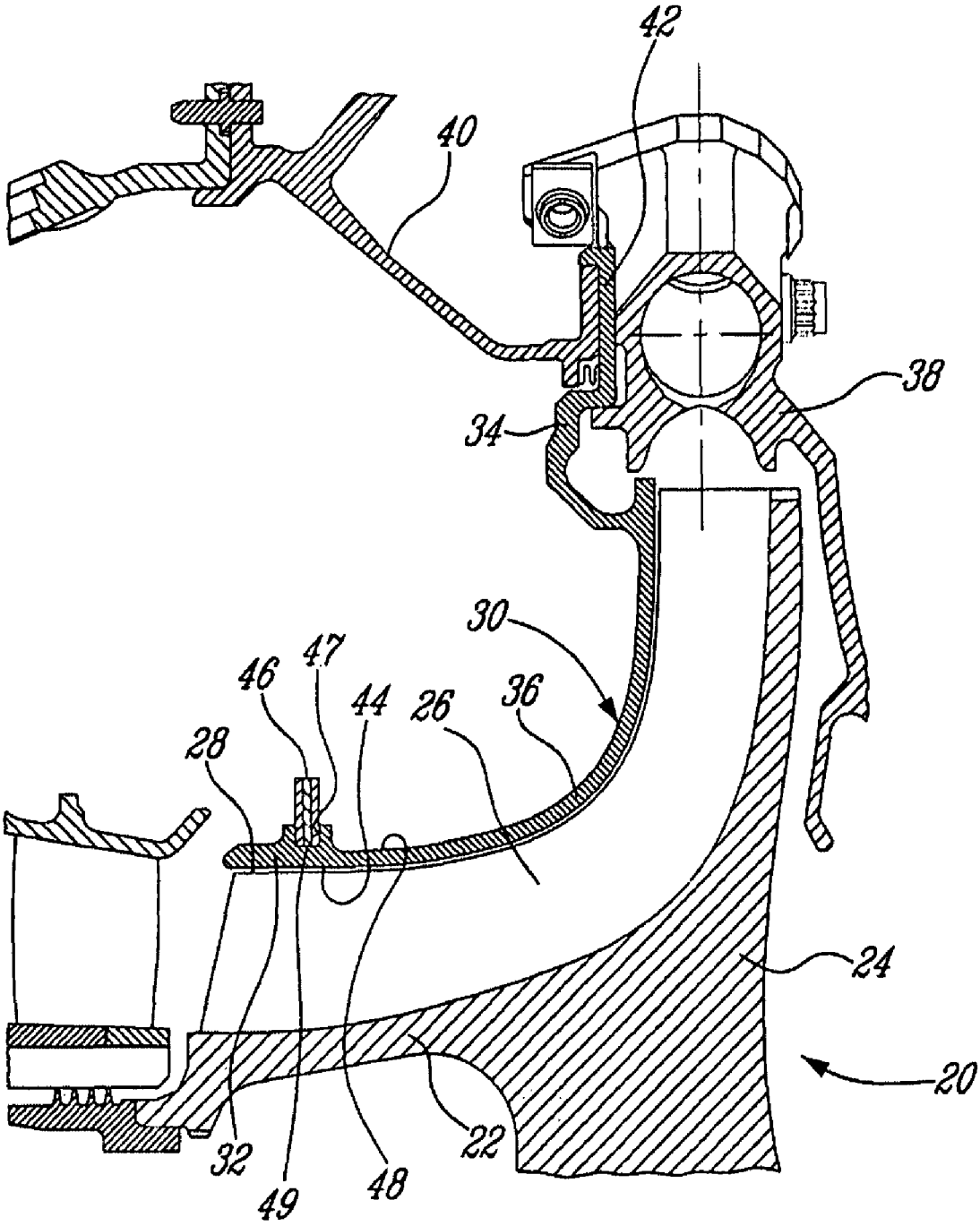
FIG. 2 is an enlarged cross-sectional view of a compressor portion of the gas turbine engine shown in FIG. 1.

As shown in FIG. 2, the compressor 14 comprises an impeller or compressor rotor 20 including an inducer portion 22 and an exducer portion 24 mounted for rotation about a central axis 11 (FIG. 1) of the engine 10. The compressor rotor 20 has a series of circumferentially distributed blades 26 extending radially outwardly to tip ends 28. The compressor rotor 20 is surrounded by a stationary annular compressor shroud 30. The compressor shroud 30 comprises an axially extending forward end portion 32 and a radially extending aft end portion 34 integrally interconnected by a knee 36 defining a bend from axial to radial. The compressor shroud 30 is cantilevered from the diffuser 38 and the rear case 40 of the engine via a flange spigot 42 defined in the aft end portion 34 of the shroud 30.

The compressor shroud 30 has a radially inner surface 44 defining an outer flow path boundary for the air flowing across the impeller 20. The radially inner surface 44 of the shroud 30 is disposed in close proximity to the tip ends 28 of the blades 26 and defines therewith a tip clearance. In use, the rotation of the compressor rotor 20, the pressure variation in the air flowing across the compressor 14 and mechanical sources can induce vibrations in the compressor shroud 30. Excessive vibration can cause fatigue or cracking of the structural member thereby adversely affecting the overall efficiency of the engine and its durability.

It is herein proposed to provide a mechanical damper at the forward end portion 32 of the shroud 30 in order to minimize the effect of vibratory stress and improve durability. As shown in FIG. 2, this can be achieved by mounting a ring 46 in an annular channel 47 defined in a radially outwardly facing surface 48 of the shroud 30. The ring 46 is self-supported in the channel 47, and is allowed to slip therein. The ring 46 is configured so as to be preloaded in frictional engagement on its inside diameter with the radially outwardly facing, circumferential surface 49 of the channel 47 and at its axially facing sides with the axially spaced-apart sidewalls bordering the channel 47. The relative sliding movement between the ring 46 and the shroud 30 generates friction which contributes to dissipate the vibration in the shroud 30.

As shown in FIG. 2, additional friction and, thus, additional damping can be provided through the use of a multi-turn spiral wound retaining ring of the type commonly used in order to fasten two concentric parts together. The adjacent axially-facing surfaces of the coils forming the multi-turn ring 46 provide additional frictional surfaces which contribute to further dissipate the vibrations. In this way, the friction between 1) the inner diameter of the ring 46 and the outer surface 49 of the shroud 30, 2) the axially facing end surfaces of the ring 46 and the adjacent axially facing sidewalls of channel 47 and 3) adjacent surfaces of the coils of the ring 46, all together contribute to dampen the vibrations induced in the shroud 30.

It is understood that multiple adjacent single-turn rings could be used as an equivalent to the illustrated multi-turn ring.

The WS, WSM, DNS, ES, WST and WSW retaining ring series manufactured by Smalley Steel Ring Company could for instance be used as damping rings. Other suitable retaining ring could be used as well.

Retaining rings having relatively high stiffness in the radial direction due to their narrow and tall cross-section (see FIG. 2) shall not deflect with the shroud, thereby creating relative motion (slip) between the shroud 30 and the retaining ring 47 which, in turn, results in energy absorption and damping. As shown in FIG. 2, this can be achieved with a multi-turn ring having simple rectangular cross-sectional coils with a plain inner circumferential surface seating on a correspondingly plain outer surface 49 of channel 47 on the shroud 30. The cross-section of the ring 46 can be adjusted to provide the relative stiffness with the shroud to maximize relative motion and, thus, the damping of the induced vibration.

The slip may be both radial and tangential at the inside diameter and adjacent axial faces of the channel 47 with any displacement causing slip between the ring 46 and shroud 30 as well as each of the coils of the retaining ring 46 due to its multi-turn design. It has been demonstrated that more turns of the ring significantly increases the damping by providing additional frictional surfaces as each coil slips relative to each other in addition to the slip occurring on the shroud contacting surfaces.

In view of the foregoing, it is apparent that the mechanical damper contributes to improve the durability of the shroud 30 with minimum effect on the engine configuration. Furthermore, the use of a retaining ring as a mechanical damper provides a simple, reliable and relatively inexpensive way of damping the vibration induced in the shroud 30. It is also easy to implement, maintain and manufacture.

The above description is meant to be exemplary only, and one skilled in the art will recognize that changes may be made to the embodiments described without departing from the scope of the invention disclosed. For example, while the present invention has been described in the context of an impeller shroud, it is understood that a similar concept could be used on other engine static parts prone to vibrations, such as rotor shrouds in general, stators and baffles. The damping ring in some instances could also be mounted to an internal surface of the part to be dampened as opposed to the illustrated external mounting. Still other modifications which fall within the scope of the present invention will be apparent to those skilled in the art, in light of a review of this disclosure, and such modifications are intended to fall within the appended claims.

What is claimed is:

1. A gas turbine engine compressor comprising a rotor mounted for rotation about a central axis of the engine, the rotor having a series of circumferentially distributed blades, each of said blades having a tip, a shroud surrounding said rotor and having a radially inwardly facing surface defining a flowpath and with the tip of said blades a tip clearance, the shroud projecting forwardly in a cantilevered fashion from an impeller, and a multi-turn spiral ring mounted to a radially outwardly facing surface of the shroud at a cantilevered forward end thereof, said multi-turn spiral ring being in frictional engagement with said radially outwardly facing surface of said shroud, the friction and relative motion between the multi-turn spiral ring and the shroud provides damping of the vibration deflection induced in the shroud.

2. The gas turbine engine compressor defined in claim 1, wherein the multi-turn spiral wound retaining ring mounted in a channel defined in the radially outwardly facing surface of the shroud.

3. The gas turbine engine compressor defined in claim 1, wherein the multi-turn spiral ring is received in an annular channel having a radially outwardly facing surface and two axially spaced-apart sidewalls, the friction between 1) the multi-turn spiral ring and the radially outwardly facing surface of the annular channel and 2) the multi-turn spiral ring and the axially spaced-apart sidewalls of the annular channel both contributing to the damping of the vibrations in the shroud.

4. The gas turbine engine compressor defined in claim 1, wherein the shroud further has a supported aft end and an intermediate knee defining a bend from axial to radial between said cantilevered forward end and said supported aft end.

5. The gas turbine engine compressor defined in claim 1, wherein said multi-turn spiral ring has a cross-section defined by a radial height and an axial width, and wherein said radial height is greater than said width.

6. The gas turbine engine compressor defined in claim 1, wherein said multi-turn spiral ring has a radial stiffness sufficient to create a relative sliding motion between the multi-turn spiral ring and the shroud in response to vibratory induced deflections of the shroud.

7. The gas turbine engine compressor defined in claim 1, wherein the multi-turn spiral ring has a substantially rectangular cross-section with a plain shroud engaging surface preloaded on the radially outwardly facing surface of the shroud.

8. A vibration damping arrangement comprising a static gas turbine engine part subject to vibrations, a multi-turn spiral wound retaining ring mounted in frictional engagement with the static gas turbine engine part, the multi-turn spiral wound retaining ring being mounted in an annular channel defined in an outer surface of the static gas turbine engine part, each turn of the multi-turn spiral wound retaining ring being in frictional contact with an adjacent turn, the multi-turn spiral wound retaining ring having a radial stiffness sufficient to cause the retaining ring to slip on the static gas turbine engine part in response to vibratory motion of the static engine part, the slip between the adjacent turns of the retaining ring as well as between the retaining ring and the static gas turbine engine part both causing frictional damping of the vibration induced in the static gas turbine engine part.

9. The vibration damping arrangement defined in claim 8, wherein the multi-turn spiral wound retaining ring has a cross-section defined by a height and a width, the height extending in a radial direction, whereas the width extends in an axial direction, and wherein the height is greater than the width.

10. The vibration damping arrangement defined in claim 8, wherein the static gas turbine engine part is a diffuser mounted impeller shroud.

11. A method of damping vibration induced in a static annular shroud, wherein the annular shroud is subject to deflections induced by vibration, the method comprising: opposing the deflections by externally mounting a retaining ring in frictional engagement with an outer surface of the annular shroud, the retaining ring having a cross-section defined by a height and a width, the height extending in a radial direction, whereas the width extends in an axial direction, the height being greater than the width, the retaining ring having a radial stiffness sufficient to substantially not conform to the shroud deflections, thereby resulting in relative sliding motion between the shroud and the retaining ring, the relative sliding motion providing frictional damping of the vibration.

12. The method defined in claim 11, wherein the annular shroud has a cantilevered end, and wherein the method comprises: mounting the retaining ring to said cantilevered end.

13. The method defined in claim 11, wherein the retaining ring has multiple adjacent turns, the retaining ring being a multi-turn spiral wound retaining ring, and wherein the method comprises using the friction between adjacent turns to provide additional friction damping.

14. The method defined in claim 11, wherein the retaining ring has a substantially rectangular cross-section with a plain inner circumferential surface, the method comprising preloading the plain inner circumferential surface against a corresponding plain circumferential surface of a channel defined in the outer surface of the annular shroud.

15. A method of damping vibration induced in a static gas turbine engine part, comprising: providing a multi-turn spiral wound retaining ring, the multi-turn spiral wound retaining ring having at least two turns; and causing said spiral wound retaining ring to slip on an external surface of the static gas turbine engine part and said at least two turns to slip relative to each other as a reaction to vibration induced in the static gas turbine engine part, the friction between the multi-turn retaining ring and the static gas turbine engine part as well as the friction between the at least two turns of the multi-turn spiral wound retaining ring providing vibration damping.

16. A method as defined in claim 15, wherein the multi-turn retaining ring has a substantially rectangular cross-section defining a plain circumferential surface, the method comprising engaging said plain circumferential surface on a corresponding plain circumferential surface of the static gas turbine engine part.

* * * * *